US007032641B2

(12) United States Patent
Jacobsen et al.

(10) Patent No.: US 7,032,641 B2
(45) Date of Patent: Apr. 25, 2006

(54) TRANSPORT SYSTEM FOR A MOULD-STRING CASTING PLANT

(75) Inventors: Ole Anders Jacobsen, Tisvildeleje (DK); Vagn Mogensen, Gentofte (DK)

(73) Assignee: Disa Industries A/S, Herlev (DK)

( * ) Notice: Subject to any disclaimer, the term of this patent is extended or adjusted under 35 U.S.C. 154(b) by 0 days.

(21) Appl. No.: 10/514,496

(22) PCT Filed: May 16, 2002

(86) PCT No.: PCT/DK02/00321

§ 371 (c)(1),
(2), (4) Date: May 20, 2005

(87) PCT Pub. No.: WO03/097275

PCT Pub. Date: Nov. 27, 2003

(65) Prior Publication Data

US 2005/0211409 A1 Sep. 29, 2005

(51) Int. Cl.
*B22C 9/20* (2006.01)

(52) U.S. Cl. ..... 164/323; 164/130

(58) Field of Classification Search ..... 164/130, 164/131, 168, 323, 324
See application file for complete search history.

(56) References Cited

U.S. PATENT DOCUMENTS 3,659,701 A * 5/1972 Taccone ..... 198/736
3,744,552 A 7/1973 Lundsgart
4,112,999 A * 9/1978 Gasper ..... 164/154.6
4,180,156 A * 12/1979 Popov et al. ..... 198/726
4,248,290 A * 2/1981 Hermes ..... 164/154.2
4,304,288 A * 12/1981 Pluim ..... 164/72
4,540,036 A * 9/1985 Jensen ..... 164/323
6,092,585 A * 7/2000 Larsen et al. ..... 164/130
6,263,952 B1 * 7/2001 Hunter ..... 164/324

FOREIGN PATENT DOCUMENTS

DE 2 311 253 10/1973
WO WO 96/30140 10/1996

* cited by examiner

*Primary Examiner*—Len Tran
(74) *Attorney, Agent, or Firm*—Stites & Harbison; Douglas E. Jackson

(57) ABSTRACT

In a transport system for a mould-string casting plant comprising a moulding machine (1) delivering a plurality of uniform mould parts (3) to a string of moulds on the transport system transporting the moulds from the moulding machine (1) to a pouring station (4) and further on to a solidification and cooling section (II, III, IV) and ending at a knock-out station in which the castings are taken out of the moulds (3), the transport system comprises in combination—a second section (II), in which the moulds (3) in the string are transported slidingly by means of movable longitudinal side rails (8) applying a positive lateral force on each side of the mould string (3) and moving in an advancing and longitudinal stepwise manner synchronised with the movement provided by the pressure plate (2) of the moulding machine (1), and—a third section (III), in which the transport is effected by means of a walling beam system (6, 7). In this way it is possible to provide a longer high-precision transport than possible when only using either side rail transport or walking beam transport.

5 Claims, 2 Drawing Sheets

TRANSPORT SYSTEM FOR A MOULD-STRING CASTING PLANT

TECHNICAL FIELD

The present invention retates to a transport system for a mould-string casting plant of the kind set forth hereafter.

BACKGROUND ART

In transport systems for mould-string casting plants of this kind it is known to effect the transport by means of the pressure plate expelling the formed moulds from the moulding machine and supplementary mechanical means in the form of movable longitudinal side rails applying a positive lateral force on each side of the mould string and moving in an advancing and longitudinal stepwise manner synchronised with the movement provided by the pressing plate of the moulding machine, said mechanical means being positioned close to the moulding machine for gripping the moulds immediately after leaving said moulding machine. A transport system of this kind is known from U.S. Pat. No. 3,744,552.

Another supplementary mechanical means for providing the forward movement of the mould string comprises an array of equally spaced, parallel, rigid rails extending in the direction of the movement of the mould string from the moulding machine. The array of equally spaced rails comprises fixed rails and movable rails, said movable rails being moved by mechanical and hydraulic means and positioned between the fixed rails in an alternate manner, the movable rails being moved in a cyclic manner synchronised with the movement provided by the pressing plate of the moulding machine, said cyclic movement of the movable rails comprising lifting the movable rails to support the mould string, moving one step forward, lowering the movable rails leaving the mould string supported on the fixed rails, and moving the movable rails back to their initial position ready to be lifted again to support the mould string in order to minimise the vertical movement of the moulds and reduce the friction, the so-called fixed rails are lowered during the forward movement of the movable rails. A transport system of this kind is known from DE-2,311,253.

It is furthermore known to provide a belt conveyor for performing the final transport of the mould string towards the knock-out station, said belt conveyor being positioned to receive the mould string after sufficient solidification of the mouldings, whereby the precision of the transport is less significant for obtaining precision mouldings.

In connection with modern moulding machines having a high production rate, the distance over which the mould string has to be transported before reaching the knock-out station increases and furthermore, the distance over which the precision conveyance of the mould string is essential for obtaining precision mouldings by avoiding dislocation of individual mould parts relative to one another, is also increasing. Accordingly, there exists a demand for extending the high-precision part of the transport system as well as the total length of the transport system.

DISCLOSURE OF THE INVENTION

It is the present invention to provide a transport system for a mould-string casting plant of the kind referred to above, with which it is possible to provide a longer high-precision transport part and a longer total length of the transport system, and this object is achieved with a transport system of said kind, which according to the present invention also comprises the features set forth hereafter. With this arrangement, the high-precision sliding transport of the mould string can be extended relatively long until problems arise in connection with the contact between the side rails for the sliding transport, whereupon a walking beam transport can take over the transport of the mould string, said walking beam transport also being of a relatively high-precision type avoiding dislocation of mould parts relative to one another, and the walking beam transport system extending as long as possible until a possible belt conveyor transport system can take over the transport after sufficient solidification of the castings. The combination of the pressure plate transport, side rail transport and walking beam transport provides the possibility of extending the high-precision transport to a longer distance than possible with the existing systems which only use pressure plate transport combined with either side rail or walking beam transport.

Preferred embodiments of the invention, the advantages of which will be evident from the following detailed part of the present description, are revealed hereafter. Due to the fact that the supplementary mechanical movement means of the second section are not active in the start of the mould string, a special method for emptying the transport system may be implemented, as revealed hereafter.

BRIEF DESCRIPTION OF THE DRAWINGS

In the following detailed part of the present description, the invention will be explained in more detail with reference to the exemplary embodiments of a transport system for a mould-string casting plant according to the invention shown in the drawings, in which.

DESCRIPTION OF THE PREFERRED EMBODIMENTS

Figure 1:
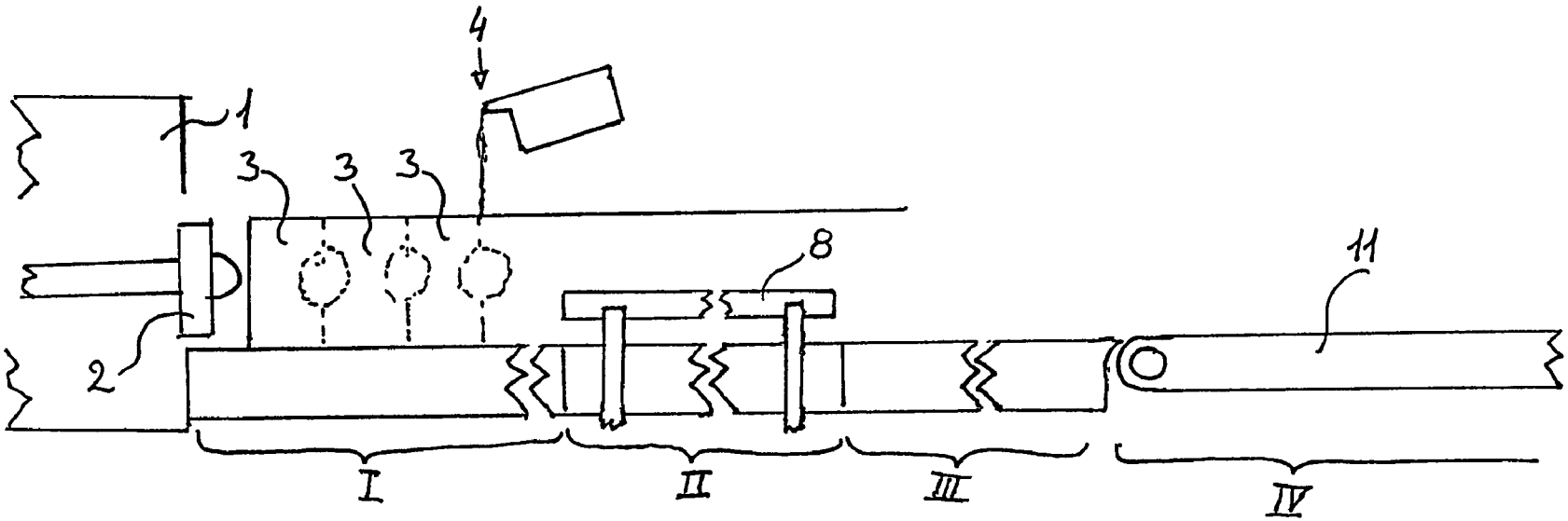
FIG. 1 shows a schematic side view in elevation of a preferred embodiment.

The transport system shown in FIG. 1 comprises the hydraulically operated pressure plate 2, which stepwise advances the uniform casting moulds 3 along the first section of the conveyor part I, which extends from the moulding machine to just beyond the pouring section 4. The second section of the transport system II covers the solidification and cooling sections. The third section of the transport system III takes over the transport in the cooling section and transfers the moulds with the casting therein to a synchronised belt conveyor 11, likewise being part of the cooling section leading to the knock-out station, where the castings are taken out of the moulds.

In the first part of a conveyor part I, the moulds are guided in a channel provided by means of a bottom and possibly two fixed side rails guiding the produced moulds during their sliding movement towards the pouring station.

Figure 4:
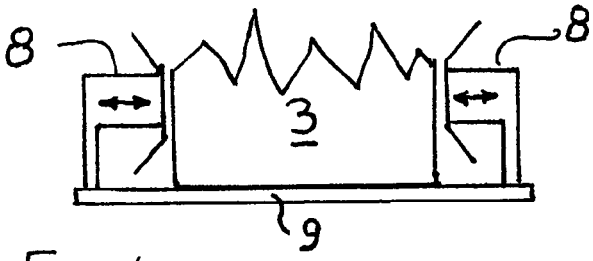
FIGS. 4 and 5 show a cross-sectional view and a side view of a side rail moving system.
Figure 5:
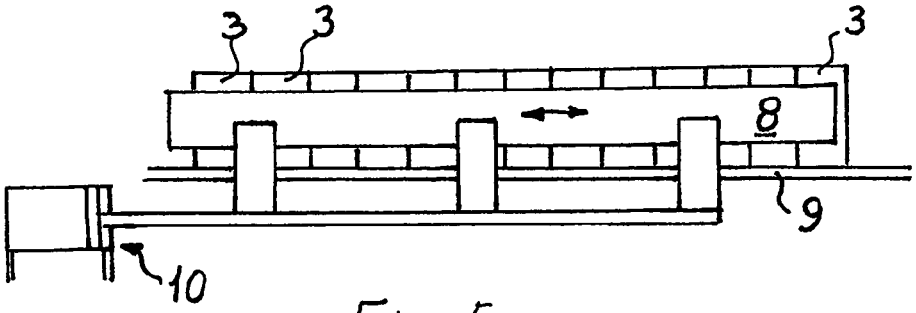

The side rail transport system in the second transport section II shown in FIGS. 4 and 5 comprises longitudinal side rails 8 movable to engage and grip the moulds 3, whereupon the rails 8 are advanced one step, resulting in the gripped mould string advancing at same rate along the base plate 9. The longitudinal side rails 8 are then released from the moulds in the mould string 3 and returned to the original position. The forward and backward movements of the side rails 8 are performed by means of a piston 10 shown in FIG. 5, and the respective longitudinal and transverse movements of the side rails and the mould string are denoted by arrows in FIGS. 4 and 5.

The side rail transport system may extend all the way from the moulding machine to the walking beam transport system but preferably only from a position downstream of the pouring station 4, in which position the castings have achieved a solidified outer shell.

Figure 2:
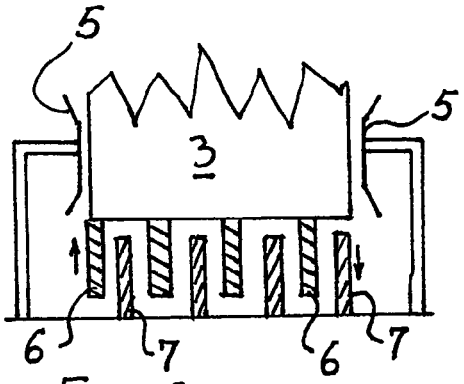
FIGS. 2 and 3 show a cross-section of a walking beam transport system in different movement phases.
Figure 3:
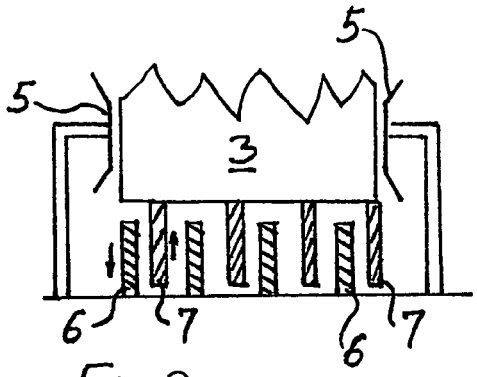

The walking beam transport system of the third transport section III shown in FIGS. 2 and 3 provides a longitudinal stepwise movement of the moulds 3 as follows: The movable rails 6 are raised to support the moulds 3, as shown in FIG. 2, whereupon the movable rails 6 are moved in longitudinal direction one step forward and lowered to the position shown in FIG. 3, whereby the moulds 3 are supported on the fixed rails 7. In this position, the movable rails 6 are moved back ready for raising again to support the moulds 3 and moving them one step further forward, said forward movement naturally being performed in synchronism with the stepwise forward movement provided by the pressure plate 2 and the side rail transport system II. In FIGS. 2 and 3, the vertical movement of the movable rails 6 are highly exaggerated, the raising of the moulds 3 should be minimal in order to avoid dislocation of the moulds 3 relative to one another at the transition between the second transport section II and the third transport section III. In this respect it is also possible to lower the so-called fixed rails 7 to secure the support on the movable rails 6 during the forward movement, and raising the fixed rails 7 again before lowering the movable rails 6. In this way, the vertical movement of the moulds 3 may be reduced to close to zero.

The first transport section I provides a secure and stable contact pressure or weighting between the mould parts in the pouring station 4, and the friction between the moulds 3—positioned between the moulding machine 1 and the pouring station 4—and the sliding section is sufficient to maintain this contact pressure even when the hydraulically operated pressure plate 2 is moved back into the moulding machine 1 for producing the next mould 3.

In order to be able to empty the system, when changing from one type of casting to another or any other production stop, lightweight dummy blocks can be inserted instead of new moulds, to enable all the cast moulds to reach the supplementary mechanical means for providing the forward movement thereof, and using the hydraulically operated pressure plate 2 to move said dummy blocks forward and thus provide the sliding movement of the casting moulds 3 in the section I. Another way of emptying the system would be to provide a separate set of longitudinal side rails 8 for the section I, which however would only be brought into engagement with the casting moulds 3 during such emptying of the transport system, in order to maintain the above advantage of providing a desired contact pressure between the mould parts in the mould string during normal operation. In order to maintain a suitable pressure between the mould parts during emptying, this side rail transport system for the section I should possibly be advanced further than the corresponding transport system in the section II.

One further advantage of the system in accordance with the present invention should be mentioned, namely that at the pouring station 4, the mould string 3 may be supported by a planar surface free from side rails or movable rails under the bottom, whereby possible failures of the moulds during pouring resulting in outrunning hot metal can easily be cleaned up, at least compared to the big problems arising when such outrunning metal runs into the movable and stationary rails 6, 7, or into the moving mechanism for the side rails 8 in a similar position. Furthermore, the free sides and planar bottom of the transport system in section I provide the possibility of pouring from the side or even from the bottom of the mould string, which is especially interesting in connection with casting of light alloys.

In connection with moulding machines producing a high number of moulds per hour, it is necessary to have a relatively long transport section in order to cause a solidification and cooling of the castings before the knockout station. In this connection, it is interesting to have several different types of transport systems along the solidification and cooling sections, i.e. combining the first sliding transport section I with a side rail transport section II and possibly a synchronised belt conveyor 11, as shown in FIG. 1, and combinations of side rail transport systems and walking beam systems at the bottom are provided, especially when the casting moulds have a tendency of disintegrating due to the drying out of the mould 3 during pouring, solidification and cooling of the castings, said drying out possibly causing malfunction of the side rail transport system, at which point the walking beam system takes over.

The invention has been described above in connection with preferred embodiments thereof and several modifications may be envisaged within the scope of the following claims.

The invention claimed is:

1. Transport system in a mould-string casting plant wherein the casting plant includes a moulding machine delivering a plurality of uniform mould parts to a string of undivided moulds on the transport system which said transport system transports the moulds (a) from the moulding machine to a pouring station, (b) further on to a solidification and cooling section and (c) to an end at a knock-out station in which the castings are taken out of the moulds, said transport system comprising:

a first transport section, in which the undivided moulds in the string are transported slidingly on a first slidingly surface, the sliding transport being provided by the movement of a pressure plate of the moulding machine expelling the moulds from the moulding machine, said first transport section extending from the moulding machine through the pouring station and being free of side rails;

a second transport section, in which the undivided moulds in the string are transported slidingly on a second sliding surface from the first section through an initial part of the solidification and cooling section by movable longitudinal side rails, said longitudinal side rails also applying a positive lateral force on each side of the undivided mould string while at the same time moving the undivided mould string along the second sliding surface in an advancing, sliding and longitudinal stepwise manner synchronized with the movement provided by the pressure plate of the moulding machine, and a third transport section, in which the undivided moulds in the string are transported through a further part of the solidification and cooling section which transport is effected by a walking beam system, the walking beam system of the third transport section being free of engaging side rails.

2. Transport system in accordance with claim 1, further comprising a fourth section following the third section, said fourth section being a conveyor belt.

3. Transport system in accordance with claim 1, wherein said first section extending to a position downstream of the pouring station, in which position the castings have achieved a solidified outer shell.

4. Transport system in accordance with claim 1, wherein the sliding surface of the first and second sections consists of planar surfaces or a single planar surface.

5. Transport system in accordance with claim 1, wherein the sliding surfaces of the first and second sections are divided into a planar upstream surface and a downstream grille-like surface.

* * * * *